US008192338B2

(12) United States Patent
Solow et al.

(10) Patent No.: US 8,192,338 B2
(45) Date of Patent: Jun. 5, 2012

(54) FOLDABLE TRANSPORTABLE MULTIPLE FUNCTION PILATES EXERCISE APPARATUS AND METHOD

(75) Inventors: Howard J. Solow, Boulder, CO (US); Julie Lobdell, Longmont, CO (US); Scott Douglas Nelson, Denver, CO (US); Gregory Caluori, Lakewood, CO (US); Michael M. Arbuckle, Austin, TX (US)

(73) Assignee: Mad Dogg Athletics, Inc., Venice, CA (US)

( * ) Notice: Subject to any disclaimer, the term of this patent is extended or adjusted under 35 U.S.C. 154(b) by 852 days.

(21) Appl. No.: 10/553,930

(22) PCT Filed: Apr. 23, 2003

(86) PCT No.: PCT/US03/12812

§ 371 (c)(1),
(2), (4) Date: Jun. 23, 2008

(87) PCT Pub. No.: WO2004/096376

PCT Pub. Date: Nov. 11, 2004

(65) Prior Publication Data

US 2008/0248935 A1 Oct. 9, 2008

(51) Int. Cl.
*A63B 26/00* (2006.01)
*A63B 21/02* (2006.01)
*A63B 21/04* (2006.01)

(52) U.S. Cl. ..... 482/142; 482/123; 482/129

(58) Field of Classification Search ..... 482/142, 482/140, 110, 148, 123, 129, 130
See application file for complete search history.

(56) References Cited

U.S. PATENT DOCUMENTS

| | | | |
|---|---|---|---|
| 1,621,477 | A | 3/1927 | Pilates |
| 1,738,987 | A | 12/1929 | Dattilo |
| 1,934,389 | A | 11/1933 | Charles |
| 2,733,922 | A | 2/1956 | Diego |
| 3,770,267 | A | 11/1973 | McCarthy |
| 4,023,818 | A | 5/1977 | Troller |
| 4,706,953 | A | 11/1987 | Graham |
| 4,884,802 | A | 12/1989 | Graham |
| 5,066,005 | A | 11/1991 | Luecke |

(Continued)

FOREIGN PATENT DOCUMENTS

| | | |
|---|---|---|
| CH | 332 368 | 10/1958 |

(Continued)

OTHER PUBLICATIONS

European Patent Office, Supplementary European Search Report, May 20, 2011, 4 pages, Munich, Germany.

(Continued)

*Primary Examiner* — Allana Lewin
(74) *Attorney, Agent, or Firm* — Jones Day

(57) ABSTRACT

A multi-function Pilates exercise apparatus featuring a foldable frame (200-203), a counterbalance mechanism (271), a wheeled base (90), a rotatable pulley riser with a flexible pulley mount (112), gear changing apparatus (FIG. 9) and adjustable footbar (471). The frame is designed to fold into an upright position and to be rolled to a desired location. The pulley assemblies may be rotated and positioned below the carriage rails. The gear changing apparatus permits the user to adjust the carriage position with a single handed operation. The exercise system includes a reformer, a pole apparatus, and mat mode including a long/short box.

21 Claims, 13 Drawing Sheets

U.S. PATENT DOCUMENTS

| | | | | |
|---|---|---|---|---|
| 5,338,278 | A | 8/1994 | Endelman | |
| 5,364,327 | A | 11/1994 | Graham | |
| 5,607,381 | A | 3/1997 | Endelman | |
| 5,616,107 | A * | 4/1997 | Simonson | 482/97 |
| 5,653,670 | A | 8/1997 | Endelman | |
| 5,681,249 | A | 10/1997 | Endelman | |
| 5,772,560 | A | 6/1998 | Watterson et al. | |
| 5,792,033 | A | 8/1998 | Merrithew | |
| 5,807,217 | A | 9/1998 | Endelman | |
| 5,899,834 | A | 5/1999 | Dalebout et al. | |
| 6,120,425 | A | 9/2000 | Endelman | |
| 6,186,929 | B1 * | 2/2001 | Endelman et al. | 482/121 |
| 6,338,704 | B1 | 1/2002 | Endelman | |
| 6,371,895 | B1 * | 4/2002 | Endelman et al. | 482/135 |
| 6,394,933 | B1 | 5/2002 | Yu | |
| 6,461,408 | B2 * | 10/2002 | Buxbaum | 95/55 |
| 6,527,685 | B2 * | 3/2003 | Endelman et al. | 482/121 |
| 6,685,606 | B2 * | 2/2004 | Endelman | 482/142 |
| 6,926,650 | B2 * | 8/2005 | Endelman et al. | 482/121 |
| 6,971,976 | B2 * | 12/2005 | Endelman et al. | 482/121 |
| 7,104,937 | B2 * | 9/2006 | Arbuckle et al. | 482/142 |
| 7,125,368 | B2 * | 10/2006 | Endelman | 482/142 |
| 7,125,369 | B2 * | 10/2006 | Endelman | 482/142 |
| 7,125,370 | B1 * | 10/2006 | Schaffner et al. | 482/142 |
| 7,163,498 | B1 | 1/2007 | Abelbeck | |
| 7,163,500 | B2 | 1/2007 | Endelman | |
| 7,270,628 | B2 * | 9/2007 | Campanaro et al. | 482/95 |
| 7,288,053 | B2 | 10/2007 | Endelman et al. | |
| 7,294,098 | B2 | 11/2007 | Barnard et al. | |
| 7,306,549 | B2 * | 12/2007 | Francis | 482/100 |
| 7,465,261 | B2 | 12/2008 | Barnard et al. | |
| 7,674,211 | B2 | 3/2010 | Uygan | |
| 7,682,297 | B2 | 3/2010 | Graham | |
| 7,857,736 | B2 | 12/2010 | Merrithew et al. | |
| 2001/0056011 | A1 | 12/2001 | Endelman et al. | |
| 2002/0151419 | A1 * | 10/2002 | Barnes et al. | 482/142 |
| 2003/0119636 | A1 | 6/2003 | Endelman | |
| 2004/0176227 | A1 | 9/2004 | Endelman | |
| 2006/0293156 | A1 | 12/2006 | Trees | |
| 2007/0084230 | A1 | 4/2007 | Krause et al. | |
| 2007/0087921 | A1 | 4/2007 | Graham | |
| 2008/0248935 | A1 * | 10/2008 | Solow et al. | 482/142 |
| 2009/0247376 | A1 | 10/2009 | Merrithew et al. | |
| 2010/0004101 | A1 | 1/2010 | Solow et al. | |

FOREIGN PATENT DOCUMENTS

| | | |
|---|---|---|
| CH | 369 404 | 5/1963 |
| DE | 17 89 189 | 5/1959 |
| DE | 16 58 736 | 11/1970 |
| DE | 33 13 839 | 11/1984 |
| EP | 0 174 896 | 3/1986 |
| FR | 2625907 | 7/1989 |
| FR | 2661155 | 10/1991 |
| WO | WO 02/083251 | 10/2002 |
| WO | WO 03/081987 A1 | 10/2003 |
| WO | WO 2005/051496 A2 | 6/2005 |
| WO | WO 2009/061321 | 5/2009 |

OTHER PUBLICATIONS

PCT, International Search Report, Sep. 17, 2003, 3 pages.

* cited by examiner

FOLDABLE TRANSPORTABLE MULTIPLE FUNCTION PILATES EXERCISE APPARATUS AND METHOD

FIELD OF THE INVENTION

This invention relates generally to the field of Pilates exercise equipment and more particularly to a machine which combines three Pilates exercise systems—reformer, pole, and mat in one footprint, and which may be folded into an upright position for storage and rolled for relocation.

BACKGROUND

A Pilates reformer exercise apparatus typically includes a wheeled platform carriage which rides on parallel rails or tracks on a rectangular wooden or metal frame. Most devices employ a series of parallel springs or elastic members which connect the carriage to the foot end of the frame. The springs are manually interchangeable in order to provide a variable resistance.

The carriage typically includes stationary shoulder pads and a head rest. It is desirable to be able to convert the carriage with its raised shoulder pads and a head rest into a flat surface.

A foot bar is located at the foot end of the device so that the user can press one or both feet against the foot bar and push the carriage against the spring resistance. Adjusting the position of the carriage in relation to the foot bar is important to accommodate different body types, and is typically accomplished by manually moving a spring bar into different gear settings at the foot end of the reformer or by adjusting the foot bar position. It is desirable to provide a simple mechanism which allows for gear adjustment without requiring the user to interrupt the flow of exercise to make the necessary adjustment.

Pulleys are often located at the head end of the reformer frame. The pulleys, may be adjustable in height during exercises where the user pulls the carriage by means of a rope or strap threaded through the pulley. It is desirable to provide a fully articulating swivel pulley, thereby enabling the user to pull the carriage through its entire path without binding or dragging. It is also desirable to allow the user to adjust the height position of the pulley, and to lower the pulleys to a height below the reformer rails.

Reformers are usually over 7 feet in length, and commercial models exist either as stationary units, or stackable units. The stationary units are difficult, impractical or time-consuming to move. Wheels have been added to the legs of such stationary units, but are of limited value, as they are bulky and ungainly to move, while the large amount of space required for the footprint of the unit remains the same. Stackable units typically require at least two persons to break down and stack in another location, or on a rolling cart, which then is wheeled to another location. It is, therefore, desirable to provide a device that can be folded into a minimal, space-saving footprint, which can be transported, if desired, by one individual.

It is desirable from the standpoint of economy of cost and space to provide a integrated Pilates machine which combines three Pilates machines-reformer, pole system and mat in one footprint, thus enabling the user to perform in this one machine most of the exercises in the full Pilates repertoire. In the current invention, the user can with no or very little compromise, and with ease of transition, perform exercises in the reformer mode, the pole system mode, and in a mat flat padded platform mode.

The present invention provides an attractive, durable, versatile, space-saving, and cost-saving commercial Pilates machine, which may be easily folded in to a minimal footprint and transported and stored out of the way.

SUMMARY OF THE INVENTION

The current invention features an improved Pilates machine. One embodiment of the invention includes an integrated piece of equipment which combines three Pilates machines-reformer, pole system and mat in one footprint, thus enabling the user to perform in this one machine up to 90% of the exercises of Pilates repertoire. The user can, with virtually no compromise, and with ease of transition, perform exercises in the reformer mode, the pole system mode, and a mat flat padded platform mode. The invention includes the hinging of a professional-grade, heavy duty frame, so that the machine may be folded into an upright position; and a wheeled base, so that the folded upright machine may be wheeled to various locations for storage. A counterbalance is provided to assist in folding and unfolding the machine. A hinged carriage is provided to facilitate conversion from reformer mode to mat mode. A single hand gear changing mechanism is provided, enabling the user to easily change the gear positions of the reformer with a simple single motion, without requiring the user to interrupt the flow of exercise by getting off the reformer to make the necessary adjustment. A fully articulating swivel pulley which may be rotated and lowered below the rails is provided.

BRIEF DESCRIPTION OF THE DRAWINGS

The current invention may be more easily understood, and its benefits would become more apparent, with the viewing of the following figures.

DETAILED DESCRIPTION OF EMBODIMENT

Three Mode Folding Reformer

Figure 1:
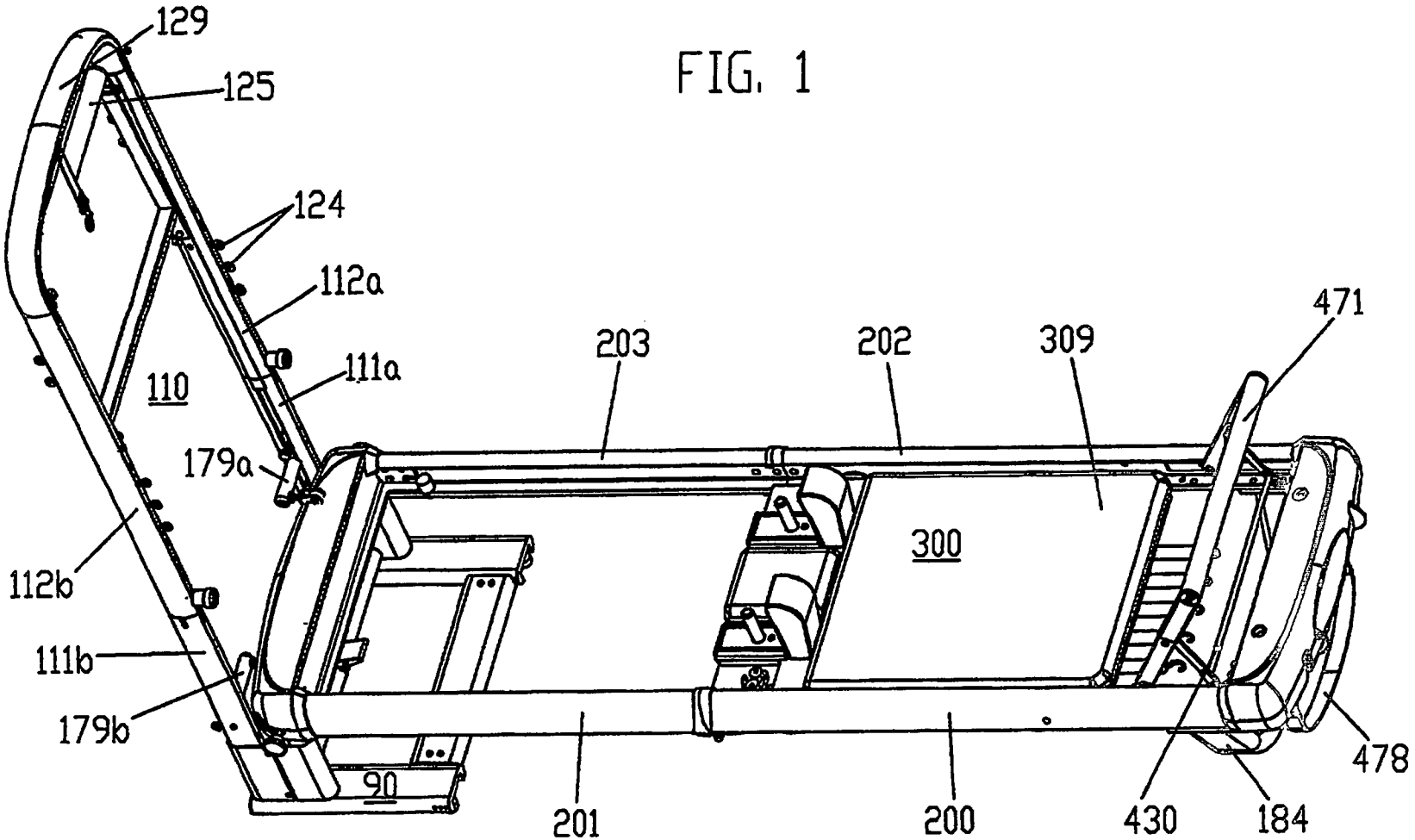
FIG. 1 is a perspective view of a reformer in an extended position.
Figure 2:
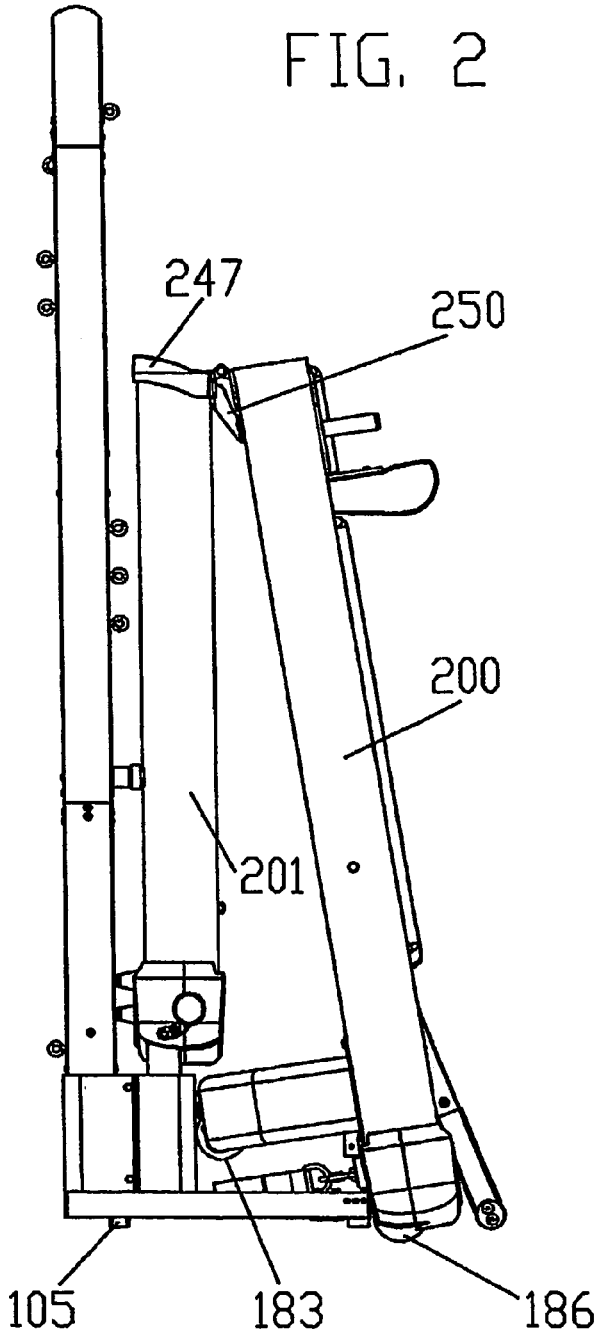
FIG. 2 is a side view of a reformer in a folded position.

Referring now to FIG. 1, which is a perspective view of an extended reformer in an unfolded position, the reformer includes a carriage 300 which slides on wheels which travel along a right rail and a left rail. The right rail comprises a right foot side rail section 200 which is attached by a hinge to a right head side rail section 201. The left rail comprises a left foot side rail section 202 which is attached by a hinge to a left head side rail section 203. The device may be folded at the hinges so that the rail sections stand generally upright. In this example, when the device is folded as illustrated in FIG. 2, the top of the head rail sections are generally upright, and the bottom of the foot rail sections abut the head base assembly 90 of the reformer.

The current embodiment is a commercial duty design such as would typically be used in exercise studios. The folding design is useful to permit alternative uses of floor space in the studio, and to facilitate transport of the device by rolling it to another location. In this example, a counterbalance mechanism is provided in order to help offset the weight of the machine while folding or unfolding the device. A torsion spring counterbalance mechanism permits one person to fold the machine by applying a lifting force of about 25 pounds of force to a lift handle.

Frame

In this example, the frame includes rail sections, a head cross member and a foot cross member between the rail sections, a head base support, and a foot end base assembly. The frame may also include a lift handle which may extend from the right side rail to the left side rail and provide additional support for the frame.

Figure 3:
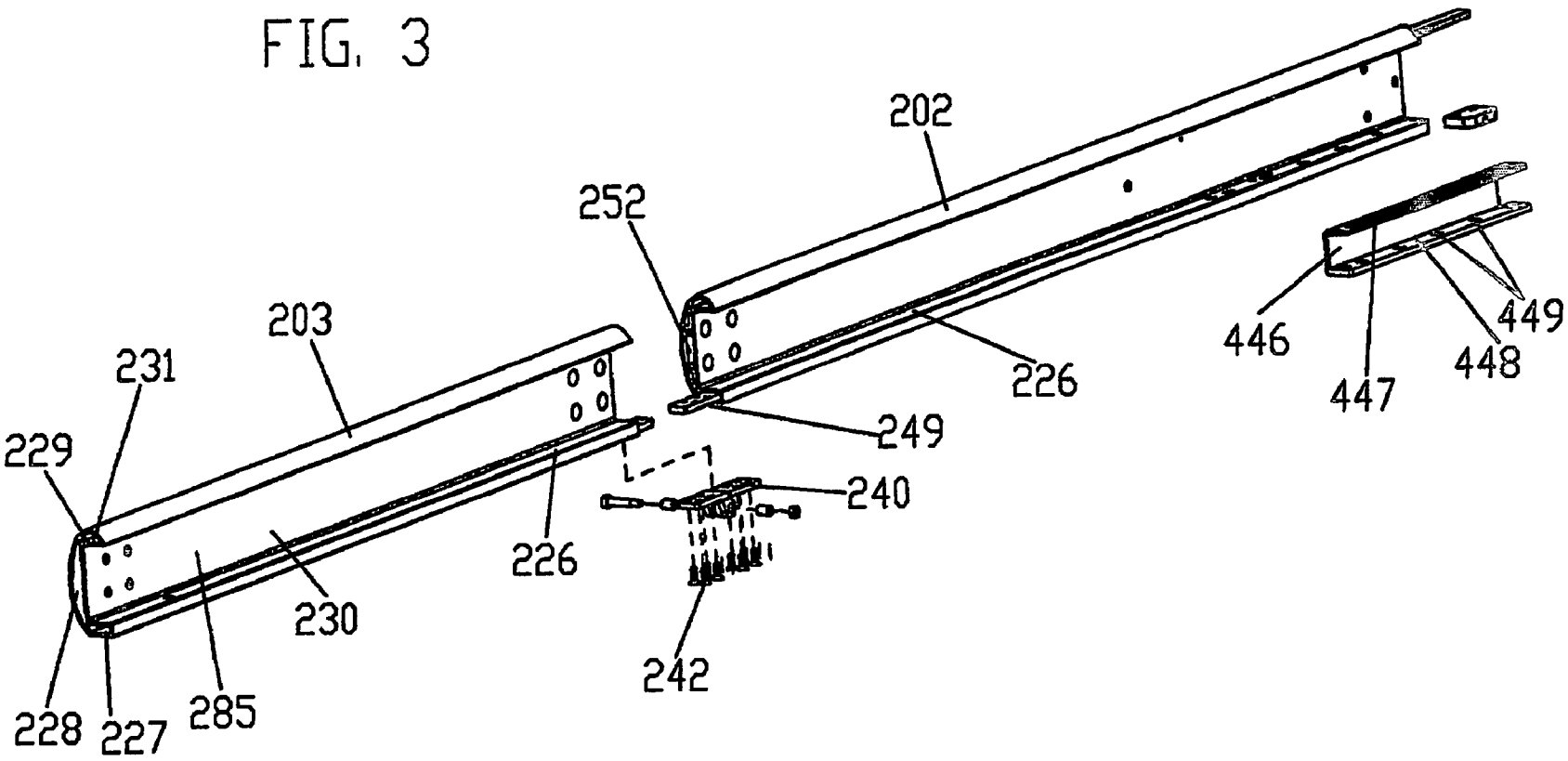
FIG. 3 is a detail of a left rail.

Referring now to FIG. 3, which is a perspective view of the left side rail assembly, the frame sections 202, and 203 are preferably extruded aluminum. The extrusion has a general C-shaped cross section, with an internal bottom wall 226, a side wall 230, and a top wall 231 that create cavities including a bottom cavity 227, a side cavity 228, and a top cavity 229. The cavities provide a space for inserting reinforcement elements, alignment plates, and nut plates. The bottom wall 226 serves as a wheel rail for supporting the carriage wheels 340 (not shown), and the side wall 230 serves as a guide for carriage horizontal wheels 343 (not shown).

Figure 5:
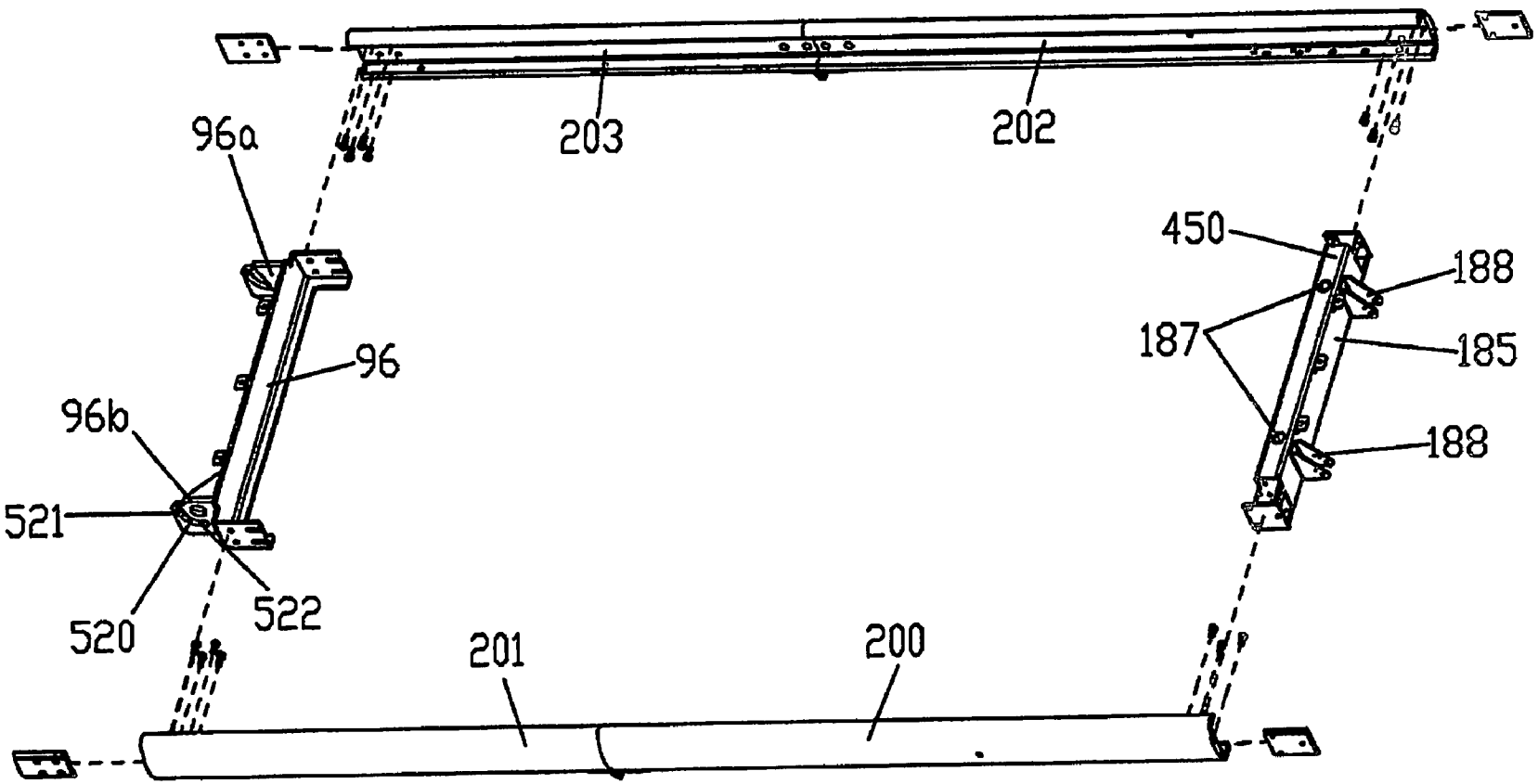
FIG. 5 is a perspective view of detail of the head cross member and the foot cross member.

Referring now to FIG. 5, a head cross member 96 is mounted between the left and right head side rail sections. The head cross member 96 includes a left head cross member flange 96*a* and a right head cross member flange 96*b*. Each flange includes a curvilinear slot 520 with a rest position conic stop 521 and a folded position conic stop 522 which are part of a frame locking mechanism. The foot cross member 185 is mounted between the left and right foot side rail sections. The foot cross member includes foot board insert holes 187 and foot cross member wheel brackets 188.

Hinge and Alignment

Referring to FIG. 3. in this embodiment, alignment of the left head end side rail 203 and the left foot end side rail 202 is accomplished with a heavy-duty middle hinge 240 attached to the side rail sections with hinge mounting bolts 242 to a nut plate 249 positioned in the bottom cavity 227 of the rail sections, and by alignment plates inserted in the rail sections. The alignment plates include a male rail alignment plate 251 (not shown) with two rounded pegs, and a female rail alignment plate 252 with holes corresponding to the rounded pegs. In the unfolded state, the pegs engage the holes so as to laterally align the extrusions.

In order to align the rolling surface bottom wall 226 of the side rail sections, one or more shims 248 (not shown) may be inserted under a portion of the hinge. The right head end side rail and right foot end side rail sections are hinged in a similar manner. Referring again to FIG. 2, the joints between the rail sections are covered with a decorative strip 247. A lift handle 250, which also serves to maintain the width between the side rails, is attached between the left and right foot rail sections. In other embodiments, the lift handle may not extend between the left and right foot rail sections.

The shimming between the hinge and the rail's bottom surface insures that the rail sections are installed so that the bottom wall wheel track 226 is flat and the carriage wheels can roll smoothly over the hinge joint. In manufacturing the device, the distance from the hinge mounting surface to the rolling surface is measured for each extrusion pair of head and foot rail sections. Shims are placed as required to insure that the two rolling surfaces are flat.

Head Base

The head end base provides several functions including supporting the machine, providing ballast to resist tipping, holding the arbor for the torsion spring, providing a rail locking mechanism to prevent undesired rail rotation, and supporting the poles.

Figure 4:
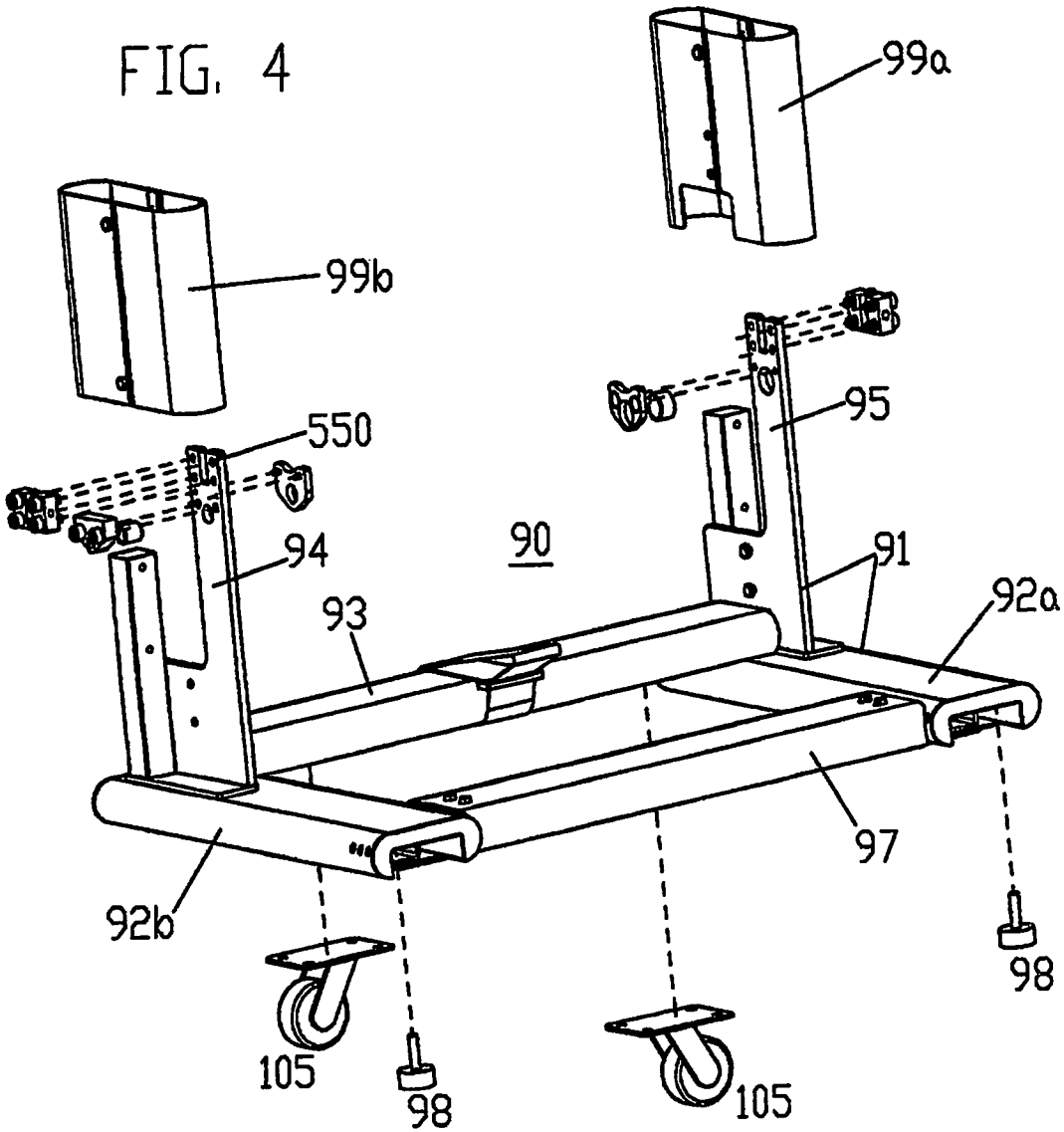
FIG. 4 is a perspective view of detail of the head base.

Referring now to FIG. 4 which is a perspective view of the head base, and to FIG. 5 which is a detail view of the head cross brace, the head base assembly 90 includes a frame 91 comprising a head base u-shape footing 92 which has a left foot member 92*a*, a right foot member 92*b*, a head base lateral member 93, a right vertical support 94, a left vertical support 95. In this embodiment, a lateral member 97 is provided between the left foot member 92*a* and the right foot member 92*b*. Head base levelers 98 are provided on the left and right foot members 92*a* and 92*b* in order to level the machine. In this embodiment, the frame elements are welded or bolted together. In an alternate embodiment, the frame 91 may be cast as a single piece which includes the u-shape footing, the vertical supports, and the cross brace. Two swiveling caster wheels 105 are mounted under the head base lateral member 93. Weights are typically mounted within portions of the lateral member 97 and the head base lateral member 93. Stiffening plates are typically mounted in the left and right foot members 92*a* and 92*b* in order to support the left and right vertical supports 95 and 94. The vertical supports may be partially covered by decorative support covers 99*a* and 99*b*.

Counterbalance Mechanism

Figure 6A:
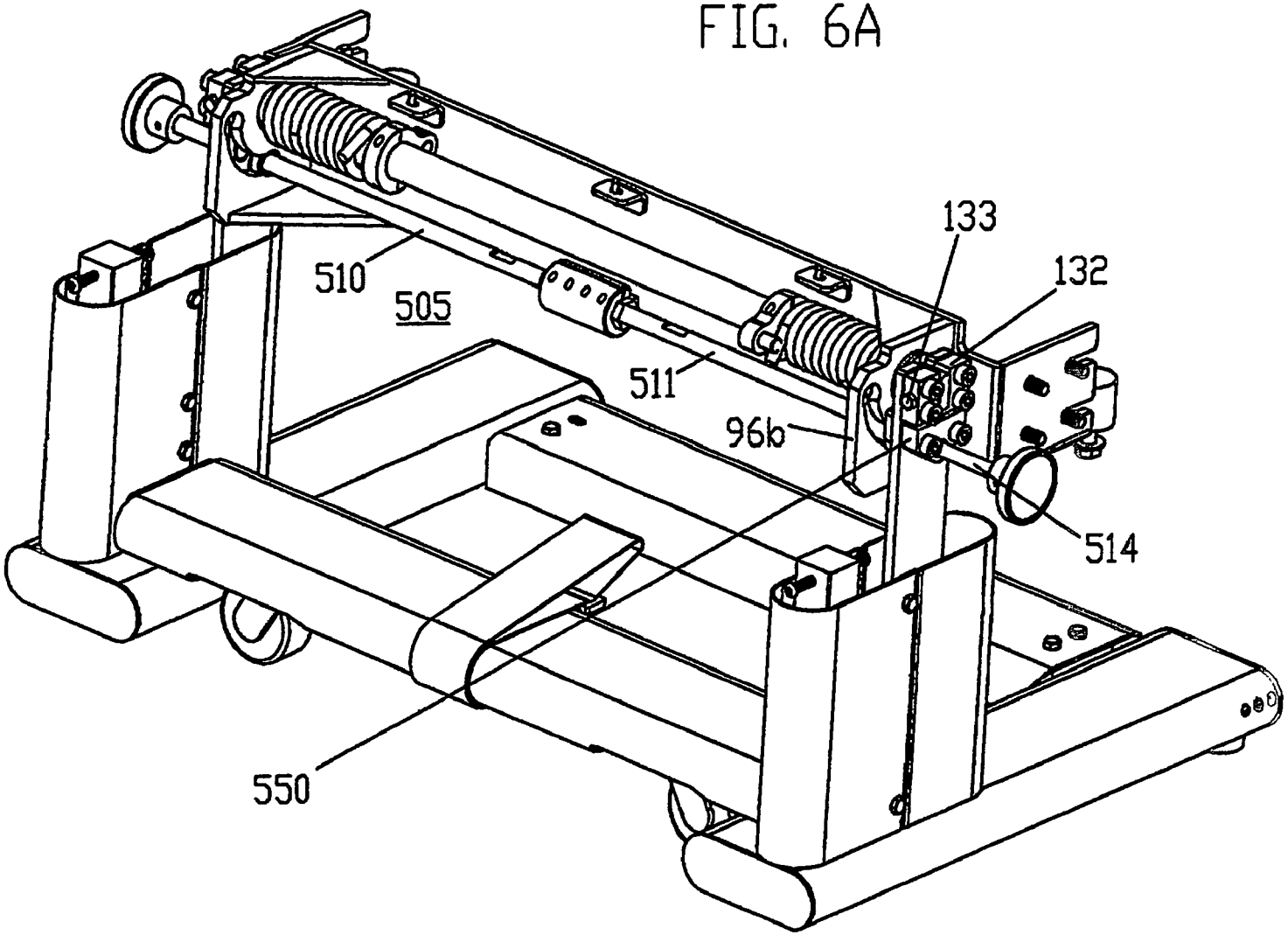
FIGS. 6A-6B are perspective views of the torsion spring counterbalance mechanism.
Figure 6B:
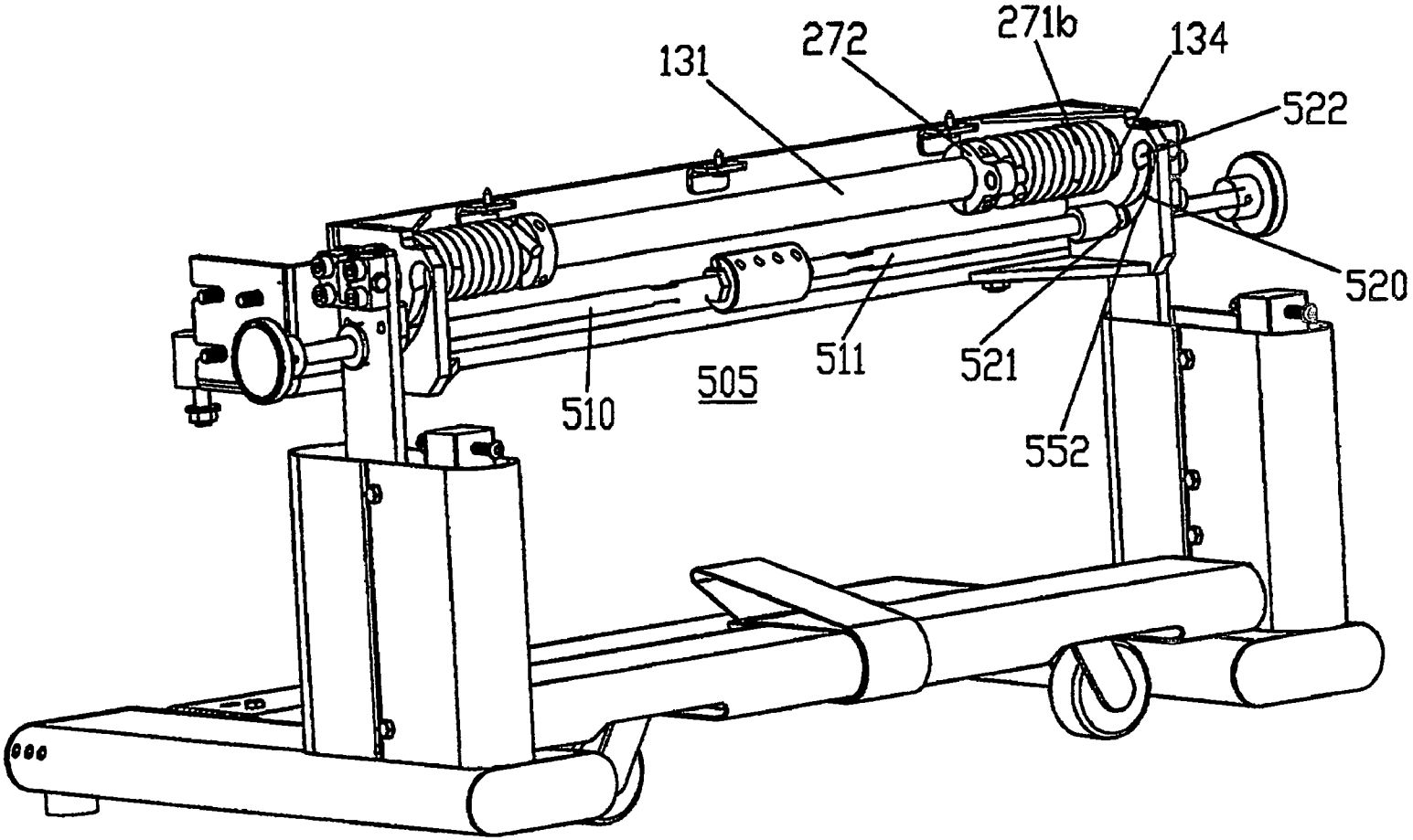

In this example, a counterbalance is provided during folding and unfolding by a pair of torsion springs 271. Alternately, other counter balance devices familiar to those skilled in the art may be used, such as a single spring, one or more gas cylinders, or a cable and weight pulley mechanism. Referring now to FIGS. 6A-6B, which are perspective views of the torsion springs, the right torsion spring 271*b* is mounted on a torsion spring support bar 131 between flange 96*b* on the head end rail cross member 96 and torsion spring retention collar 272 which is adjustably fixed to the torsion spring support bar. The head end rail cross member and its flanges pivot in relation to the torsion spring support bar 131. The torsion spring support bar passes through a bushing 134 mounted in the flange 96*b*, and is retained by torsion spring bar retainer bracket 132 positioned on the right vertical supports 94 of the head end base assembly 90. The end 135 (not shown) of the torsion spring support bar is shaped with machined flats so that the end of the bar fits into u-shaped torsion spring bar retainer bracket 132. Torsion spring bar retainer bracket screw 133 is used to secure the bracket to the bar. In this embodiment, the left torsion spring assembly is symmetrical to the right torsion spring assembly. The torsion springs are designed to apply a torque to the side rails in order to assist in folding the machine.

Rail Locking Mechanism

In this embodiment, the right and left head rail sections are attached to the head end cross member 96, which includes a right flange 96*a* and a left flange 96*b*. The head rail sections and the cross member pivot on the torsion support bar. A rail locking mechanism is provided such that when the locking mechanism is engaged, the pivotal connection becomes rigid. When the rail locking mechanism is disengaged, the left head side rail section 203 and right head side rail section 201 may be rotated about the torsion spring support shaft. In this embodiment, the locking is accomplished by engaging cone shaped male elements into corresponding female elements.

Referring to FIGS. 6A-6B, in this embodiment, the rail locking mechanism 505 includes a right and a left portion which extend through curvilinear slots 520 provided on both the right flange 96*b* and left flange 96*a* of the head end cross member 96. The frame locking shaft then passes through holes in the right vertical support 94 and the left vertical support 95 of the head end base. The curvilinear slots allow the head end rail cross member 96 to rotate about the torsion spring support bar 131 even as the frame locking shaft extends through the head end flanges. The frame locking shaft 506 has a frame locking shaft right side 510, a frame locking shaft left side 560 (not shown), and a locking shaft coupler 530 (not shown).

The curvilinear slot 520 located in the right flange 96*b* of the head end rail cross member includes a rest position conic stop 521 and a folded position conic stop 522 which are cone-shaped through holes located at each end of the slot. These conic stop features provide the female portion for the right side rail locks. A frame locking shaft right side 510 is inserted through the curvilinear slot 520 in the right flange of the head end rail cross member and subsequently through a hole in the right vertical support 94. The right side shaft is retained by a right shaft bracket 550 which includes a bushing 552 and a threaded portion 551 (not shown). The frame locking shaft right side 510 includes a cone stop section 511 which engages either the rest position conic stop 521 or the folded position conic stop 522; a smooth section 512 which may pass through the curvilinear slot 520, a threaded section 513 (not shown) which may be threaded through the threaded portion 551 of the right shaft bracket 550, and an extension section 514 which passes through the right shaft bracket. A right knob 540 (not shown) is provided on the extension section 514 so that the knob may be turned in order to tighten the frame locking shaft right side by threading the threaded section 513 (not shown) into the threaded portion 551 of the right shaft bracket 550. As the shaft is threaded into the bracket, the cone stop section 511 engages the rest position conic stop 521 or the folded position conic stop 522. The right knob 540 may be turned in the opposite direction to release the rail locking mechanism.

A similar arrangement is provided on the left side, except that left side shaft passes through a hole in the left head end base vertical support and the cone stop section engages a female counterpart on the outside edge of the left head end cross member flange. As either the right knob or the left knob is tightened, the right side threads engage the threads in the bracket and pull the bar laterally to the right so that the male cone shaped elements will engage the female elements in the right and left vertical supports.

When the male and female elements are engaged, the mechanism is locked either in a resting unfolded position or a folded position. As described more fully below, in order to fold the machine, either of the knobs is turned to disengage the cone stops from the rest position conic stops; the machine is folded; and then either knob is turned to engage the cone stops in the folded position conic stops.

The frame locking shaft provides a first locking function of holding the machine in an unfolded state during exercises, and a second locking function of holding the rails in a folded state. Alternative locking means include friction plates, a detent pin and locating hole mechanism, a face gear tooth lock, and other mechanical locking mechanisms known to those skilled in the art.

Foot Base

As illustrated in FIGS. 1, 2 and 5, the foot cross member 185 and the foot base support 184 which supports the foot end of the frame. The foot base support 184 includes a pair of foot base wheels 183, a foot cross member 185 attached to the left and right foot side rail sections, and a footbar assembly 470. The foot cross member 185 includes an integral standing platform 450 which includes two kick board insert holes 187. A user may stand on the standing platform 450 while performing standing exercises. The foot cross member 185 includes a pair of foot cross member wheels 186 as described more fully in the folding discussion below.

When the folding operation is initiated, the foot end rolls toward the head end on the foot base wheels 183. Once the foot end rail sections reach a predetermined angle, the rolling surface transitions from the foot base wheels 183 to the foot cross member wheels 186.

Footbar Assembly

Figure 7A:
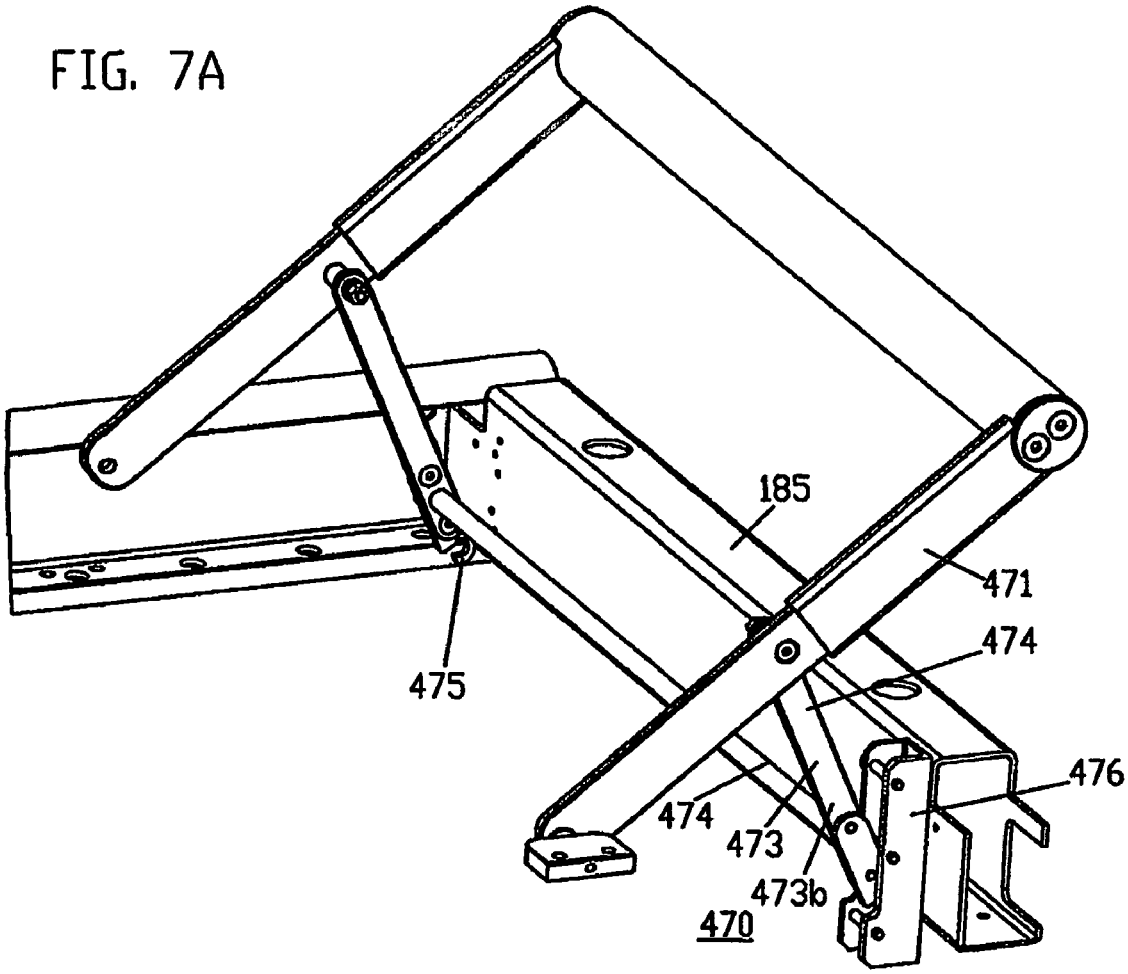
FIG. 7A is a perspective view of the footbar assembly.
Figure 7B:
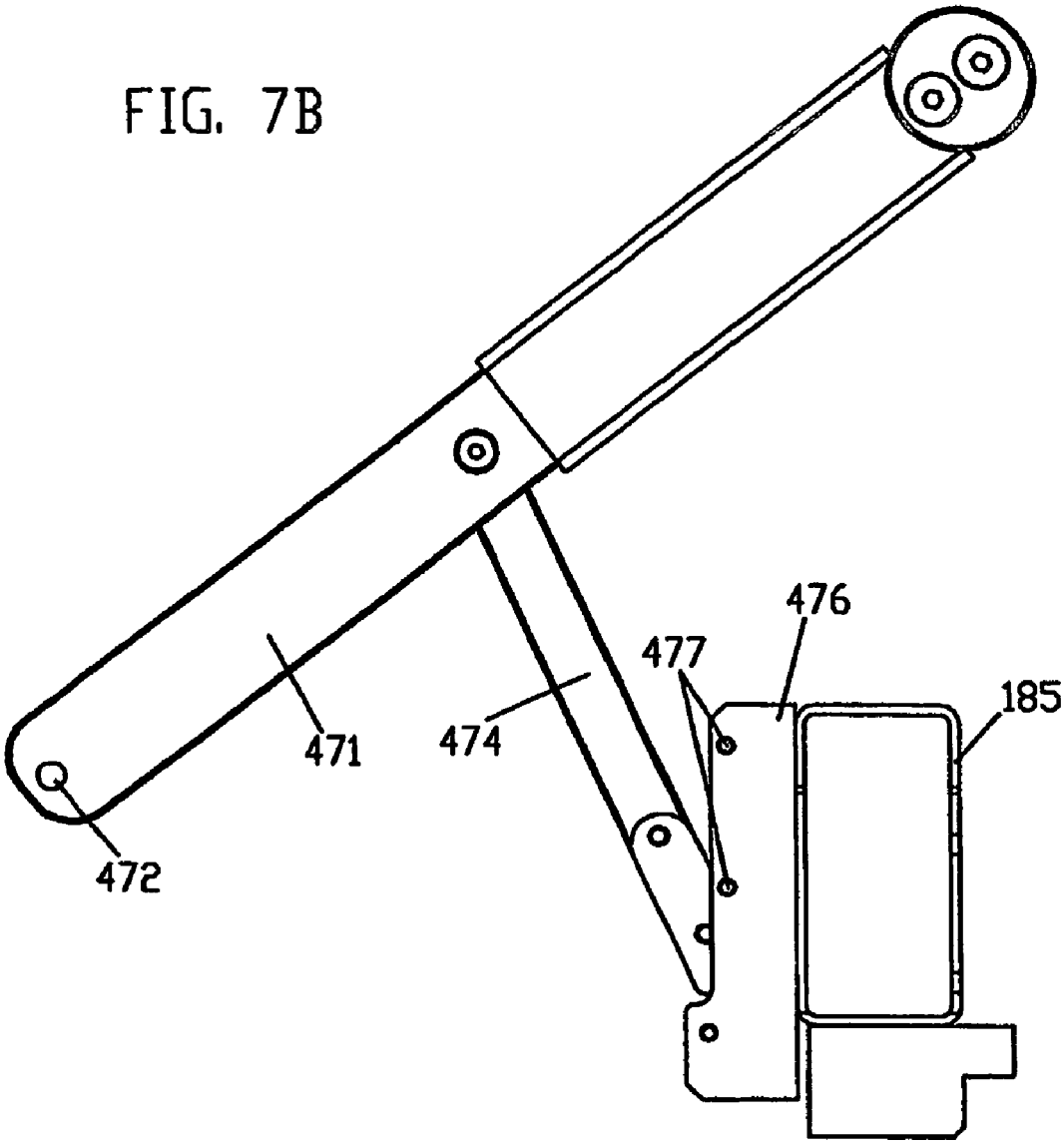
FIG. 7B is a side view of the footbar assembly.

FIGS. 7A and 7B are perspective and side views of the footbar assembly 470 which includes a u-shaped footbar 471. The footbar pivots on each foot side rail section with a footbar pivot 472. In this embodiment, an h-shaped footbar support bar 474 is attached to the footbar. Two of the legs of the 'H' are shortened. The footbar support bar includes a slot 475 at the end of each of the shortened legs 473*a* and 473*b* of the bar. The slot can be positioned over any one of three round pins 477 located in a footbar adjustment bracket 476 foot end rail cross member in order to place the footbar at various angles with respect to the side rails. The slot located at the end of each of the shortened legs of the footbar support bar is shaped in such a way as to prevent the footbar support bar, once engaged, from disengaging from its respective pin regardless of whether the footbar is pushed or pulled. To disengage the slot from its pin, the footbar support bar is rotated until the slot is removed from the pin. When folding the device, or when converting the device to a mat mode, the footbar support bar 474 is removed from the adjustment bracket 476, and the support bar and footbar may be pivoted out of the way.

Carriage

Figure 8A:
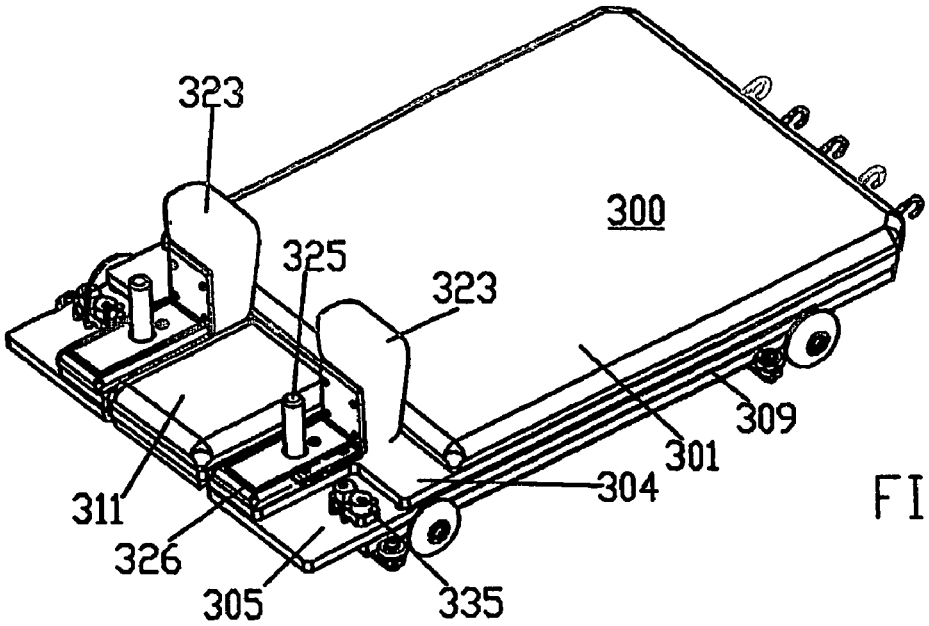
FIG. 8A is a top perspective view of the carriage.
Figure 8B:
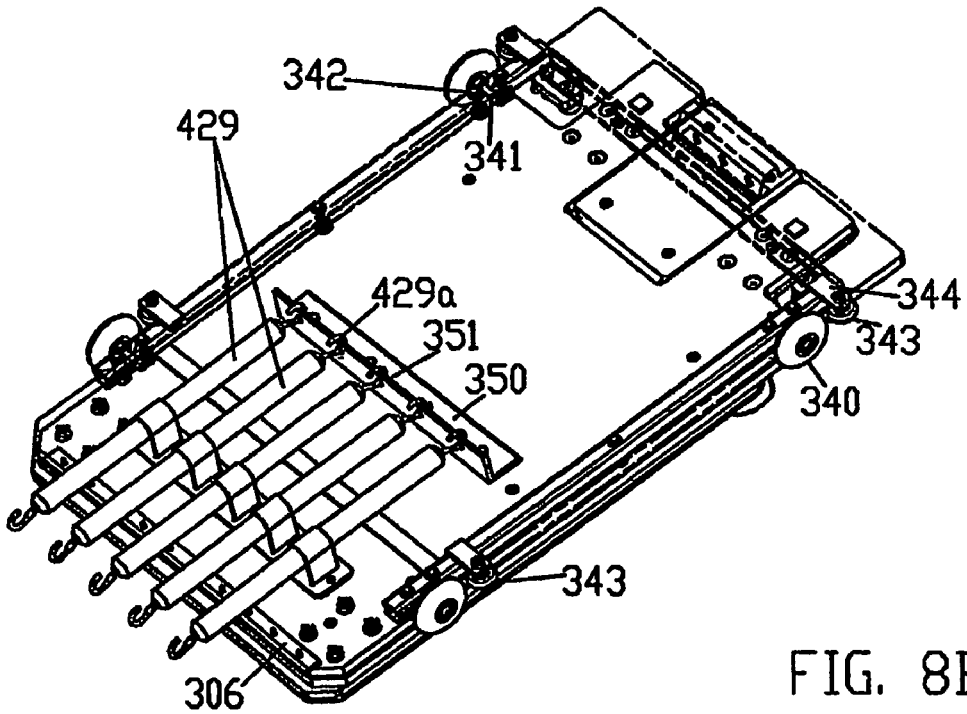
FIG. 8B is a bottom perspective view of the carriage.

Referring now to FIGS. 8A and 8B, in this embodiment, the carriage is made of two large, flat hinged portions so that it can be unfolded as discussed below. The carriage 300 is shown in a folded position such that a carriage mat 301 faces upward. A user typically sits or lies on the carriage mat while performing exercises in the reformer mode as discussed in more detail below.

In order to convert the reformer to a mat mode, the carriage is moved to the head end of the machine, unfolded and mats are placed across the top of the side rails. In this example, the carriage includes a carriage upper portion 304 which is attached by a carriage hinge 306 to a carriage bottom portion 305. A hook and loop, or other fastening means may be used to hold the carriage upper portion 304 and the carriage bottom portion 305 together when the device is folded upright.

In the unfolded mode, a first mat 307 (not shown) and a second mat 308 (not shown) may be placed over the side rails in order to provide a flat padded surface for using the device in a mat mode. The first mat and second mat preferably have a frame with several cross members, each cross member having a concave right and left edge that conforms to the upper portion of the side rails. The two parts of the mat can also be hinged. In another embodiment, the sides of the carriage top portion and the carriage bottom portion that face each other when the carriage is folded can both be upholstered. When the carriage is unfolded, the padded surface will be exposed for exercise. In this embodiment, an additional upholstered piece would be added if the exerciser requires that the entire surface of the reformer may be covered with mats. In an alternate embodiment, the unfolded carriage may have exposed pads to provide for mat exercises.

The top surface of the carriage includes a headrest 311 which is hinged with a head rest hinge 322 so that it can adjust to lie flat or incline with respect to the carriage surface. A shoulder pad 323 is located on each side of the headrest. A handgrip 325 is located between the shoulder pad and the head end of the carriage. The handgrip base 326 is preferably built up in thickness so that a short/long box 600 (not shown) may rest on the upholstered portion of the carriage and on the handgrip base to provide a wide support to stabilize the short/long box. The short/long box is described more fully below.

The top of the carriage also includes rope cleats 335 for securing a desired length of rope from the pole system as described more fully below. Once the desired rope length is selected, the rope 337 is pressed into the rope cleat 335, which may be a sailboat cleat. Excess rope may be placed through rope clearance holes 338 (not shown) located on either side of the top of the carriage toward the foot end from the cleats. The excess rope passes through the hole and is stored under of the carriage.

Rollers

FIG. 8B, is a perspective view of the underside of the carriage assembly. The carriage rides on four platform wheels 340 which travel in a channel on the wheel rails 226 of the side rail sections. The wheel axles 341 are attached to the carriage with brackets 342. In addition to the main rollers, a set of four horizontal wheels 343 is provided. The horizontal wheels are mounted to the carriage by roller brackets 344. These rollers help to keep the carriage aligned with respect to the side rail side walls 230.

Springs and Gear Change Mechanism

The resistance to moving the carriage is provided by a plurality of interchangeable and detachable springs 429. The springs may have different spring rates so that various overall resistances may be obtained by using different combinations of springs. One end of the springs is bent in a partially circular hook shape 429*a* and is attached to the carriage by engaging the hook into a hole 351 located in the carriage spring attachment angle member 350, and the other end is attached to a gear change mechanism as described below.

Figure 9:
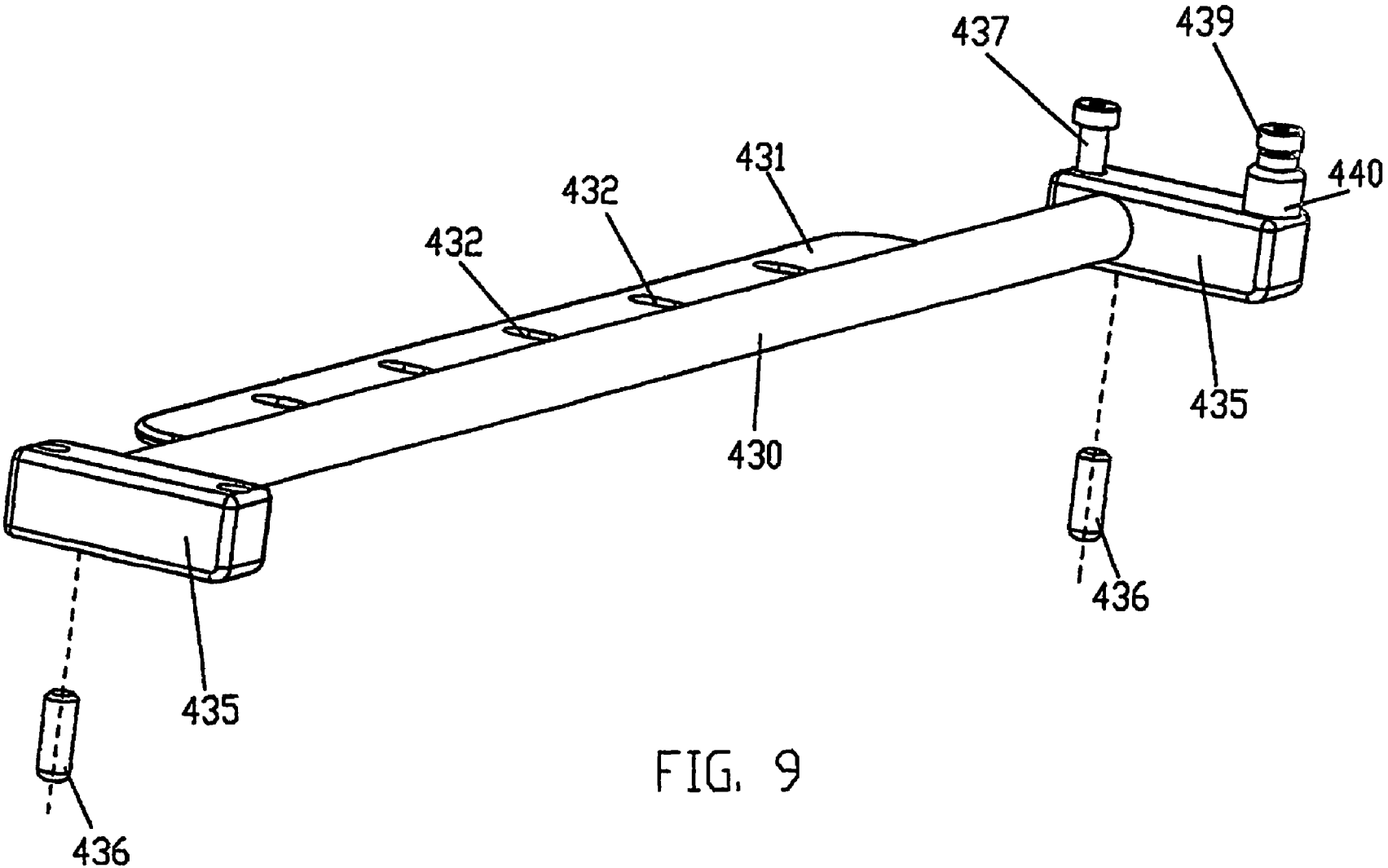
FIG. 9 is a perspective view of the carriage spring adjustment mechanism.

Referring again to FIG. 1, the distance from the carriage platform 309 to the footbar 471 at the foot of the frame is controlled by a carriage position adjustment assembly 425 which permits change of the location of a carriage spring anchor bar 430 relative to the left and right foot side rail sections. The carriage spring anchor bar typically has multiple, interchangeable tension springs attached to it. In this embodiment, the carriage spring anchor bar includes an internal bar and an elliptical tube cover. A plurality of eye bolts 433 (not shown) are threaded into the anchor bar so that the user may attach the free end of the spring to an eye bolt. In an alternative embodiment, the carriage springs may be attached by other means such as to slots 432 in a slotted mounting plate 431 integral to the carriage spring anchor bar as illustrated in FIG. 9.

In this embodiment, the carriage may be positioned at one of four preset positions relative to the foot end of the frame. The positions are noted as "3", "2", "1", and "−1", with the larger numbers being further from the foot end of the frame. The carriage spring anchor bar 430 may be set at any of these positions. The carriage spring adjustment mechanism described below is also referred to as a gear change mechanism.

Each end of the carriage spring anchor bar 430 terminates at a carriage spring bar adjustment block 435 which slides in a respective adjustment C channel 446 assembled inside of the foot end rails and may be secured in one of the noted positions. The adjustment C-channel 446 has an upper longitudinal guide slot 447 with an axis parallel to the rear side rail, and a lower positioning plate 448 with a plurality of laterally disposed slots 449 that accept a locating pin.

The following is a description of the left block and its alignment mechanism, which is symmetric to the right block and its alignment mechanism. The left block slides on a lower positioning plate 448 which is part of the adjustment C channel 446 and is positioned in the left foot side rail 202. The carriage spring bar adjustment block 435 has a locating pin 436 inserted into its bottom surface. The adjustment C-channel includes a plurality of laterally disposed slots 449 that accept the locating pin 436. The lateral slots compensate for a slight tolerance in the exact position of the locating pin and in the distance between the foot end rails, while maintaining the spring attachment bar in perpendicular alignment with respect to the side rails.

Referring now to FIG. 9, The carriage spring bar adjustment block 435 has a first shoulder bolt 437 located toward the head of the apparatus, and a second shoulder bolt 439 with a second shoulder bolt bushing 440 located toward the foot of the apparatus. A first portion of the neck of the second shoulder bushing will fit into the guide slot, and a second portion will not fit into the guide slot. An adjustment C-channel 446 is provided in the channel of the left foot side rail 202.

Referring now to FIG. 3, The adjustment C-channel 446 has an upper longitudinal guide slot 447 with an axis parallel to the left rear side rail. The first shoulder bolt 437 has a first diameter such that the diameter is smaller than width of the longitudinal slot, so that when the head edge of the carriage spring anchor bar 430 is tilted up, the first shoulder bolt 437 is tilted up through the longitudinal slot 447. The second shoulder bolt bushing 440 has an upper portion whose diameter is smaller than the width of the slot, a lower portion whose diameter larger than the longitudinal slot 447 and a transition portion, so that as the carriage spring anchor bar 430 is tilted up it pivots on the foot end lower corner of the carriage spring anchor bar block and the rounded upper portion of the bushing allows the block to pivot without interfering with the underside of the top surface of the C channel. When the block is positioned at a desired location, the user releases the carriage spring anchor bar 430, and the weight of the assembly pivots the carriage spring bar adjustment block 435 so that the locating pin 436 is inserted into a lateral slot 449 associated with the desired position, and the second shoulder bolt 439 is inserted further into the longitudinal slot 447. If a spring is left attached to the adjustment mechanism, the spring will also assist in pivoting the carriage spring bar adjustment block 435. A symmetrical arrangement is used on the right side of the carriage spring attachment bar 430.

The gear change mechanism and method, also called the carriage spring adjustment mechanism and method, are defined as "single hand operation" mechanism or methods because they can be accomplished by the user with one hand. A second hand is not required in order to release and move the carriage spring anchor bar, and a single reversible action—lifting the bar—is all that is required to release bar.

Referring now to FIG. 8B, the carriage is maintained at a set distance away from the carriage spring anchor bar 430 at each side rail by an assembly which includes a carriage stop 442 attached to at least the underneath right or left side of the carriage with a carriage stop mounting bracket 443. Each carriage stop includes a shock absorbing bumper 445, such as a rubber bumper or spring plunger, mounted on an extension 444. The bumpers come into contact with the head end face of the carriage spring bar adjustment block when the carriage is in its retracted position, thereby maintaining a minimum distance between the carriage and the carriage spring attachment bar.

To actuate the gear change mechanism, the user rocks the spring or head end of the carriage spring attachment bar upward, thereby disengaging the locating pins 436 from the lateral slots 449. The right and left first shoulder bolts 437 pass through the longitudinal slots 447. The carriage spring bar adjustment blocks 435 pivot on their rear, lower edges. The rounded shoulders of the rear second bushings enable the blocks to pivot without interference. The upper necks of the second bushings remain engaged in the longitudinal slot. Once the locating pins are disengaged from their lateral slots in the lower positioning plate 448, the carriage spring attachment bar can be moved to its new position where the locating pins will again engage respective lateral slots.

To best execute a gear change, one of the exercise springs, preferably the middle spring, is left attached to the eye bolt on the carriage spring anchor bar and all other springs removed. The tension of the spring maintains contact between the two shock absorbing bumpers of the carriage and the carriage spring bar adjustment blocks. As the carriage spring bar is moved, the bar and the carriage remain parallel, perpendicular to the axis of the longitudinal slot and racking or binding of the carriage spring adjustment bar as it is adjusted is avoided. The spring also provides a force to assist to re-engage the locating pins of the carriage spring bar adjustment blocks 435 to their respective lateral slots.

In this embodiment, changing gears can be accomplished as a single handed operation with a relatively simple and light weight mechanism. The spring attachment bar may have shapes other that shown in FIG. 9.

Risers & Pulleys

Referring again to FIG. 1, in this embodiment, a pole system 110 is provided on the head end of the machine. The pole system includes a left base pole 111*a* and a right base pole 111*b*, a left riser extension 112*a* and a right riser extension 112*b*, and a cap section 129 which connects the right and the left riser extensions. In this embodiment the base poles, riser, and cap section 129 are constructed of extruded aluminum with an elliptical cross section shape. The top aluminum piece is bent into a rounded U-shape to act as a cap 129 for the pole system. The major axis of the elliptical tube runs parallel to the length of the machine. A channel 128 (not shown) is extruded on the inside surface of the base pole and riser extension elliptical tubes only.

The poles typically support pulley assemblies 179, eye bolts 124, and a push-through bar 125. The eye-bolts 124 are used for attaching springs for various exercises. Ropes 337 (not shown) are used with pulleys 154 in a variety of reformer and pole exercises.

Figure 10A:
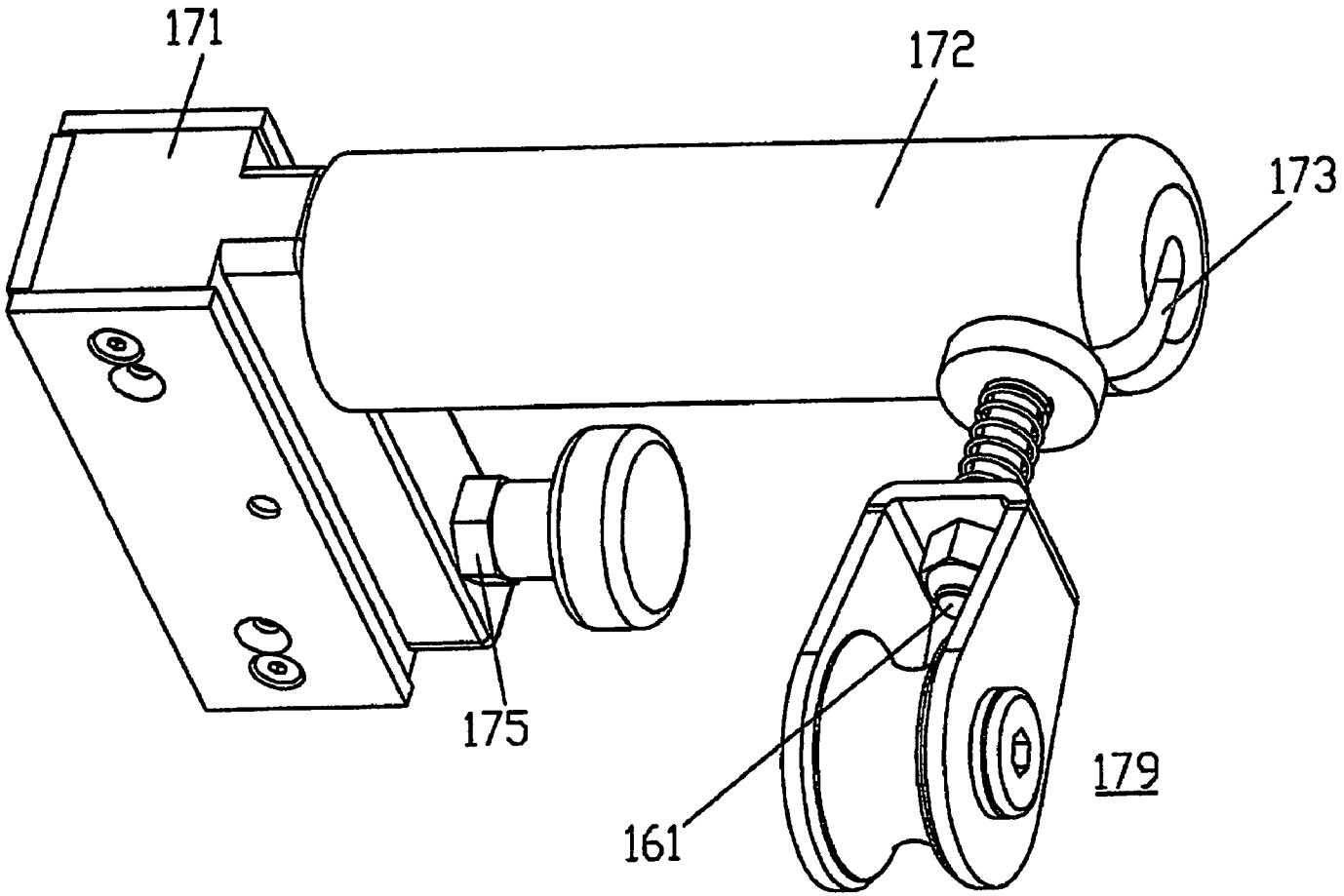
FIG. 10A is a perspective view of a pulley assembly in a first position.
Figure 10B:
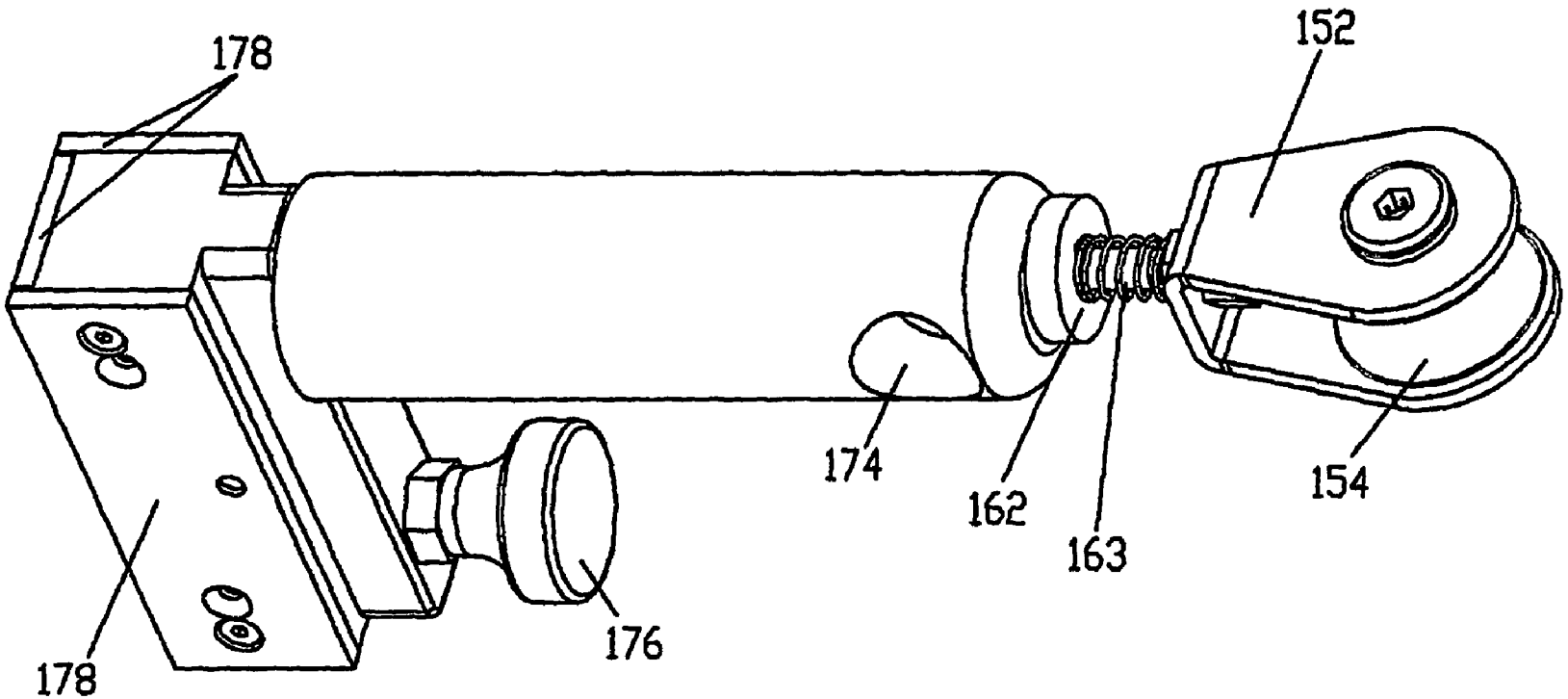
FIG. 10B is a perspective view of a pulley assembly in a second position.

Referring now to FIGS. 10A and 10B which are perspective views of the pulley assembly in a first position and a second position. The left and right pulley assemblies 179*a* and 179*b* include pulley support block handle 172 assembled to pulley support blocks 171 that engage the channel in the base poles. For instance, each pulley assembly may be positioned at a desired height above the carriage as indicated by the left pulley in FIG. 1 or positioned below the carriage as indicated by the right pulley in FIG. 1. The pulley height is adjusted by moving the pulley support blocks vertically within the channel. A pull pin assembly 175 is integral to each support block. The pull pin assembly includes a pin 176 designed to engage one of a plurality of holes located in a pulley height adjustment plate 177 (not shown) mounted within the channel. Self-lubricated plastic skid plates 178 are attached to each side of the pulley support blocks 171 to permit the blocks to smoothly slide in the channel. In order to change the pulley position, the pin of the pull pin assembly is pulled outwards, and the pulley support block is moved to a desired position, where the pin is released. Left and right scales indicating the location of the pulley support blocks are included to insure that both blocks are adjusted to the same height and to record the setting for each exercise. Once the setting is recorded, future set ups are easier and more time efficient.

The pulleys 154 are mounted to the pulley mounting brackets 152. The mounting brackets are assembled to the pulley support block handles 172 with screws 161 that terminate in spherically shaped, plastic ball mounts 165 (not shown). The pulley mounting flanges and pulleys are able to swivel to remain in line with the application of force on the ropes. The plastic ball mounts 165 are placed in spherically shaped holes 174 in the pulley support block handles 172, allowing the pulley mounting system to swivel and self-adjust commensurate with the angle of pull of the ropes. A spring 163 and washer 162 are located between each pulley bracket 152 and the respective handle 172 of the riser. Each pulley handle 172 includes a slot 173 extending from the spherically shaped hole to the exposed end 172*a* of the handle. The pulley, pulley mounting flange and pulley mounting screw can be oriented perpendicular to the machine rails providing the clearance necessary for the pulley support blocks and handles to be adjusted down below the surface of the rails. This position is required to execute certain exercises. A push-through bar 125, also known as a pass-through bar, is provided between the pole extensions. The mounting height of the push through bar can be adjusted.

In some exercises, the user pulls the carriage toward the head of the reformer with straps or ropes that are wrapped around the pulleys 154. One end of these ropes or straps typically includes a hand grip, and the other end is positioned in the retaining cleats xxx after wrapping the strap or rope around the pulleys.

Operation

This embodiment of the machine provides for 3 modes of operation—the reformer mode, the pole exercises, and mat exercises. In an alternate embodiment described below, the pole exercises are not supported. Adjustments on the machine include floor levelers 98 at the head base; pulley handle settings, push through bar height, carriage position, number of exercise springs engaged and footbar position. As described below the reformer may be folded for transport or to take up less room on an exercise floor.

Reformer Mode

In one group of exercises, the user lies or sits on the carriage and pushes one or both feet against the footbar 470 which may be positioned into various angles with an adjustable support bar 474 and a mounting bracket 476.

In another set of exercises, the user typically pulls the platform by means of a rope, cable or strap through pulleys 154 which are each adjustably mounted on the base poles 111. The user pulls the straps through the pulleys while lying supine or prone, standing, or sitting on the carriage, facing back, front, or sideways, depending on the exercise.

In another set of exercises, a short/long box 600 may be placed over the side rails, preferably so that one edge of the box rests on the right and left hand grip bases 326.

Pole Exercises

Referring again to FIG. 1, additional Pilates exercises can be performed with the pole extensions 112 and the push through bar 125.

Mat Mode

In order to unfold the carriage to convert the device for mat work, the carriage spring adjustment bar is placed in position 3—position closest to the head end of the machine. The upper portion 304 of the carriage 300 is lifted and rotated about its hinge 306 and positioned such that the headrest partially overlaps the carriage spring adjustment bar. After unfolding the carriage, a first mat 307 (not shown) and a second mat 308 (not shown) are placed over the side rails. The mats provide a large flat area on which mat work can be performed. The foot end mat includes a foot strap 478 used for certain exercises.

Folding

The folding sequence is executed by positioning the carriage, disengaging the rail locking mechanism, raising the lift bar until the head end pivots on its wheels, engaging the rail locking mechanism, continuing to either raise the lift bar or press the foot and head ends together until the foot section abuts the head base, and securing the device. The carriage is placed at the foot of the device. The carriage spring anchor bar 430 is placed in the −1 position closest to the foot end of the machine, preferably with at least one carriage spring attached.

The frame pivot locking shaft is disengaged by either turning the left hand locking shaft knob 580 counterclockwise or turning the right hand locking shaft knob 540 clockwise so that the male cone shaped elements are disengaged from their female cone shaped elements. The rails are lifted by raising the lifting bar 250 located proximate the center of the machine. The foot end of the machine will be pulled toward the head end by rolling on the foot end base wheels 183.

When the rear section has been folded to about half of its initial length, a second set of wheels 186 located on the foot cross member 185 touch the ground and the foot rail sections are folded while riding on that second set of wheels. The lifting bar is raised until the right and left head rail sections 201 and 203 come into contact with the head end of the machine. The locking mechanism is again engaged by pushing the right handed locking shaft knob 540 in and turning clockwise, or pulling the left hand locking shaft knob 580 out and turning counterclockwise, thereby engaging the cone shaped elements in the folded rest position. The right and left foot rail sections are then pulled further toward the head end of the machine.

Since the foot rail sections are longer than the head rail sections, continuing to pull the foot rail sections further toward the head end of the machine will cause the head base assembly to tilt slightly toward the head end. The pair of leveling devices 98 prevent the machine from moving when it is in its unfolded condition. When the foot rail sections are pulled further toward the head end of the machine, the head base assembly tilts toward the head of the device, thus lifting the leveling devices off of the ground so that the head end may be moved on its wheels. A hook and loop fastening strap 491 (not shown) is used to hold the foot rail sections against the head base assembly.

Once the leveling devices are lifted and the hook and loop fastening strap or other fastening mechanism is engaged, the machine can be rolled on its head base caster wheels 105 and the foot base roller wheels 186. The wheels located on the head base assembly are swivel type wheels, allowing the folded machine to be maneuvered into tight corners.

The device may be unfolded by undoing the fold strap 491, disengaging the pivot shaft locking mechanism, and controlling the rate of gravitational lowering of the foot rail sections. When the unit is fully unfolded, the pivot frame locking mechanism is engaged.

Variations of the present invention will be apparent to those skilled in the art, and many of the elements described are equally suited for substitute elements. For instance, the rail shapes, the carriage shape, the head rest, the shoulder pads, the gear changing mechanism, the counterbalance mechanism, the rail locking mechanism, and the pulley support and adjustment mechanism, and other assemblies may be varied. These and other changes familiar to those skilled in the art are anticipated by this invention.

Two Mode Folding Reformer

In this embodiment, a pole system is not provided on the head end of the machine. The cap section 129 is inserted directly on the right base pole 111*a* and the left base pole 111*b*, rather than the riser extensions. The remainder of the machine is as described above.

Folding Reformer with Locking Mechanism

In this embodiment, a folding reformer is provided without a counterbalance mechanism or a pole system. A frame locking means is provided. The frame locking means may be a conical element mechanism similar to that described above, friction plates, a detent and pin mechanism, a face gear tooth lock, or other mechanical locking mechanisms known to those skilled in the art.

Folding Reformer with Pole System

In this embodiment, a folding reformer is provided without a counterbalance mechanism or a frame locking means. A pole system is provided. The pole system includes risers, pulley mounts, and a pull-through bar.

Folding Reformer with Locking Mechanism and Pole System

In this embodiment, a folding reformer is provided without a counterbalance mechanism. A frame locking means and a pole system are provided. A frame locking means is provided. The frame locking means may be a conical element mechanism similar to that described above, friction plates, a detent and pin mechanism, a face gear tooth lock, or other mechanical locking mechanisms known to those skilled in the art. The pole system includes risers, pulley mounts, and a pull-through bar.

Alternate Axial Alignment for Carriage Position Adjustment

In this embodiment, the carriage position mechanism for both foldable and fixed reformers includes an axial alignment component in addition to a longitudinal alignment component. The longitudinal alignment component sets the distance between the carriage and the footbar. The axial alignment component keeps the carriage spring anchor bar, or its equivalent t structure, in an alignment approximately perpendicular to the side rails, as the carriage position is changed. The axial alignment may be a pin and guide slot as described above, linear bearings and guide bar, blocks captured with channels, a telescoping mechanism, or other alignment method as known to those skilled in the art.

What is claimed is:

1. A foldable Pilates exercise apparatus comprising:

a generally rectangular frame having a head end, a foot end, a hinged left side rail having a head section and a foot section, so that its head and foot sections may be folded to an upright position, and a hinged right side rail, parallel to the left side rail, the right side rail having a head section and a foot section, so that its head and foot sections may be folded to an upright position;

a movable carriage mounted on the frame, such that the carriage may be moved along the left rail and right rail between the head and foot ends, the carriage having a generally flat upper surface;

a counterbalance mechanism, such that the counterbalance mechanism provides assistance in folding the apparatus, and provides resistance when unfolding the apparatus; and at least one carriage spring member having a first end detachably connected to the carriage and a second end detachably connected in proximity to the foot end of the frame.

2. The exercise apparatus of claim 1 wherein the counterbalance mechanism comprises a shaft;

at least one torsion spring positioned on the shaft, the spring having a first end and a second end;

a means for restricting the first end of the spring from moving relative to the frame;

a means for restricting the second end of the spring from moving relative to the shaft;

such that rotating the means for restricting the first end relative to the means for restricting the second end to wind or unwind the torsion spring results in a spring force to provide a torque that resists an unfolding of the exercise apparatus and assists in folding the exercise apparatus.

3. The exercise apparatus of claim 1 further comprising a head base, such that the head base supports the head end of the frame; and a frame locking mechanism which prevents at least one of the left side rail head section and the right side rail head section from pivoting with respect to the head base.

4. The exercise apparatus of claim 3 wherein the frame locking mechanism further comprises a frame locking shaft;

a first conical male member on the frame locking shaft;

a first conical female member on the frame;

a means for securely engaging and disengaging the male conical member from the female conical member.

5. The exercise apparatus of claim 4 wherein the means for engaging and disengaging the male conical member from the female conical member further comprises a bracket positioned on the head end base assembly, the bracket having a threaded internal portion;

a threaded section on the frame locking shaft, such that the threaded section on the frame locking shaft may be threaded into the threaded internal portion of the bracket, thereby forcing the first conical male member on the frame locking shaft into the first conical female member on the frame, and the threaded section on the frame locking shaft may be unthreaded from the threaded internal portion of the bracket, thereby releasing the first conical male member on the frame locking shaft from the first conical female member on the frame; and at least one knob mounted on the frame locking shaft, such that the knob can be turned in a first direction to thread the threaded section on the frame locking shaft into the threaded internal portion of the bracket, and the knob can be turned in a second direction to unthread the threaded section on the frame locking shaft into the threaded internal portion of the bracket.

6. The exercise apparatus of claim 1 further comprising a carriage position adjustment mechanism.

7. The exercise apparatus of claim 6 wherein the carriage position adjustment mechanism further comprises a means for maintaining the axial alignment of the movable carriage with respect to the hinged left and right side rails.

8. The exercise apparatus of claim 6, wherein the carriage position adjustment mechanism is a single operation mechanism further comprising a carriage spring anchor bar having a first end in proximity to the left rail and a second end in proximity to the right rail, such that the second end of the spring member may be attached to the spring anchor bar; and a positioning element on at least one end of the carriage spring anchor bar, the positioning element including a means for adjustably positioning the carriage spring anchor bar longitudinally between the foot end and the head end of the apparatus and locking and releasing the carriage spring anchor bar, such that in the locked state the means for adjustably positioning cannot adjust the position of the carriage spring anchor bar relative to the foot end of the frame, and in the released state the means for adjustably positioning can adjust the carriage spring anchor bar relative to the foot end of the frame; and a means for axially aligning the carriage spring anchor bar in a path approximately orthogonal to the side rails as the carriage spring anchor bar is moved from a first desired setting to a second desired setting.

9. The exercise apparatus of claim 8 wherein positioning elements are integral to each end of the carriage spring anchor bar;

the means for adjustably positioning comprises at least one locating pin on at least one positioning element, and a plurality of locating slots fixed relative to the side rails, such that the locating pin may be inserted into a locating slot; and the means for axially aligning comprises at least one guide pin on each positioning element, and a guide slot fixed relative to each side rail, such that the guide pin may be inserted through the guide slot, such that the positioning elements may be tilted in order to remove the locating pin from the locating slot without releasing the guide pin from the guide slot.

10. The exercise apparatus of claim 1 further comprising a left pole located at the head end of the frame in proximity to the left side rail; and a right pole located at the head end of the frame in proximity to the right side rail.

11. The exercise apparatus of claim 10 further comprising a pole cap section having a first end attached to the top of the left pole, and a second end attached to the top of the right pole.

12. The exercise apparatus of claim 1 further comprising a left pole located at the head end of the frame in proximity to the left side rail;

a right pole located at the head end of the frame in proximity to the right side rail;

a left pulley adjustably mounted on the left pole, such that the left pulley may be positioned at a desired height; and a right pulley adjustably mounted on the right pole, such that the right pulley may be positioned at a desired height.

13. The exercise apparatus of claim 12 wherein a left pole located at the head end of the frame in proximity to the left side rail;

a right pole located at the head end of the frame in proximity to the right side rail;

the left pulley is mounted on the left pole on a left pulley rotation mechanism, such that the left pulley may be rotated at least 90 degrees with respect to the frame; and the right pulley is mounted on the right pole on a right pulley rotation mechanism such that the right pulley may be rotated at least 90 degrees with respect to the frame.

14. The exercise apparatus of claim 13 wherein the left pulley may be rotated to a position approximately perpendicular to the left side rail, and moved into a position lower than the top of the left side rail; and the right pulley may be rotated to a position approximately perpendicular to the right side rail, and moved into a position lower than the top of the right side rail.

15. The exercise apparatus of claim 13 wherein the left pulley rotation mechanism further comprises a handle with a first end adjustably mounted on the left pole and a second end;

a socket in the second end of the handle;

a slot in the second end of the handle extending at least 90 degrees around the socket;

a pulley mount rotatably positioned in the socket;

a pulley mounting bolt assembly comprising a bolt attached at a first end to a pulley bracket, and attached at a second end to the pulley mount through the slot in the second end of the handle, a washer on the bolt between the slot and the pulley bracket, and a spring on the bolt between the washer and the pulley bracket, such that the spring holds the pulley in a desired location, and such that the location may be changed by rotating the pulley bracket to a desired location such that the bolt passes through the slot extending around the socket.

16. The exercise apparatus of claim 1 further comprising a foot end support which supports the left side rail foot section and the right side rail foot section;

a foot end cross brace having a first end attached to the left side rail foot section, and a second end attached to the right side rail foot section;

at least one wheel mounted in proximity to the foot end support; and at least one wheel mounted in proximity to the foot end cross brace.

17. The exercise apparatus of claim 1 wherein the carriage further comprises an upper section;

a lower section; and a hinge attaching the upper section to the lower section, such that the upper section may be unfolded by pivoting the upper section on the hinge.

18. The exercise apparatus of claim 17 further comprising a plurality of mats, such that the mats may be placed on the side rails after the upper section of the carriage is unfolded from the lower portion of the carriage.

19. The exercise apparatus of claim 1 further comprising an adjustable footbar.

20. The exercise apparatus of claim 19 wherein the adjustable footbar further comprises a U-shaped footbar comprising a first leg pivotably mounted in proximity to the right side rail, and a second leg pivotably mounted in proximity to the left side rail;

a pivotably mounted footbar support bar comprising an H-shaped frame comprising a right leg having a first end pivotably mounted to the first leg of the footbar, and a second hooked end, a left leg having a first end pivotably mounted to the second leg of the footbar, and a second hooked end, and a center member connecting the right leg to the left leg; and at least one adjustment bracket having a plurality of pins, such that the hooked ends of the right leg and left leg may be positioned over a pin.

21. A method for storing and transporting a reformer exercise apparatus having a frame with a head end and a foot end, the frame including a first and second rail, each rail comprising a rail head section attached by a hinge to a rail foot section, the method comprising folding the reformer frame from an extended lateral position to an upright folded position by lifting a portion of the frame from a point near the center of a rail, providing a counterbalance mechanism to reduce the required lifting force, rolling, on wheels mounted on the foot end of the reformer, the first rail foot section and the second rail foot section toward the head of the reformer, pivoting the head sections of the first rail and the second rail on head rail section supports, and continuing to roll the first rail foot section and the second rail foot section toward the head of the reformer until the reformer is in a folded upright position;

securing the rails in their upright position; and rolling the folded reformer to a desired position.

* * * * *